United States Patent [19]

Marino et al.

[11] 4,034,171

[45] July 5, 1977

[54] MEANS FOR ENERGIZING A COLOR TELEVISION PICTURE TUBE DURING MANUFACTURE

[75] Inventors: Armando V. Marino, Chicago; Albert Sora, River Forest, both of Ill.

[73] Assignee: Zenith Radio Corporation, Glenview, Ill.

[22] Filed: Sept. 30, 1976

[21] Appl. No.: 728,333

[52] U.S. Cl. ..... 200/51 R; 200/61.52; 200/153 A

[51] Int. Cl.² ..... H01H 35/02

[58] Field of Search ..... 200/51 R, 61.52, 153 A, 200/275, 277

[56] References Cited

UNITED STATES PATENTS

| | | | |
|---|---|---|---|
| 1,971,585 | 8/1934 | Soreng | 200/61.52 |
| 2,198,677 | 4/1940 | Mueller, Sr. | 200/61.52 |

*Primary Examiner*—Thomas J. Kozma
*Attorney, Agent, or Firm*—John R. Garrett

[57] ABSTRACT

This disclosure depicts a means for energizing a color television cathode ray tube during manufacture. In particular, this means for energizing a color television picture tube is for use with a tube having an envelope containing an electron gun assembly and a base attached to a neck of the envelope. The base has electrically conductive pins connected to elements of the electron gun assembly wherein a first of the pins on the base carries a relatively high focus potential of many kilovolts and a second of the pins carries a substantially higher main focus lens potential. The means for energizing the tube during the manufacture comprises a socket for coupling with the base on the tube wherein the socket has a lead attached to a source of high potential, the lead being characterized by having a switch. The switch has an electrically nonconductive casing filled with a dielectric fluid. An electrically conductive contact plate within the electrically nonconductive casing is connected to the socket by a first wire; and an electrically conductive chain within the electrically nonconductive casing has a first end connected to the high potential source by a second wire. The second end of the chain is free within the electrically nonconductive casing, and the chain is sufficiently long to contact the contact plate. The chain contacts the contact plate when the casing is in a first position wherein the socket is coupled to the base. A means is provided for supporting the switch in an inverted position after the socket is decoupled from the tube. This causes the chain to fall away from the contact plate and thus de-energize the socket.

1 Claim, 2 Drawing Figures

MEANS FOR ENERGIZING A COLOR TELEVISION PICTURE TUBE DURING MANUFACTURE

BACKGROUND OF THE INVENTION

This invention relates in general to the manufacture of color television picture tubes and in particular to a means for energizing a tube during manufacture.

During the manufacture of a color television picture tube, there is a need to provide high voltages to the tube. These voltages are provided for the purpose of spot knocking, aging, etc. Typically, these voltages are applied to the tube while it moves along a conveyor belt. A socket energized with the necessary voltage and for coupling to the base of the tube moves along with the conveyor belt. Occasionally a tube is not connected to one of the sockets along the conveyor belt in which case it is necessary to de-energize the socket. A "live" socket is a potential source of electrical shocks to personnel near the conveyor belt. Also, a socket which is energized and not coupled to a base of a tube will burn out after a period of time due to arcing between the contacts of the socket. Due to the high voltage potentials used in the manufacture of a color television picture tube, it is necessary to use large mechanical switches in order to remove these high potentials from the sockets. This is undesirable since the socket must move along the conveyor belt and there usually is not room for a large mechanical switch. Mercury switches tend to break down and thus are unacceptable for this application.

OBJECTS OF THE INVENTION

It is a general object of the present invention to provide a means for energizing a color television picture tube during manufacture. Specifically, it is an object to provide a simple and reliable means for energizing a tube socket and also for removing the source of high potential from a socket which is not coupled to a tube.

BRIEF DESCRIPTION OF THE DRAWINGS

The features of the present invention which are believed to be novel are set forth with particularity in the appended claims. The invention together with further objects and advantages thereof may best be understood by reference to the following description taken in conjunction with the accompanying drawings in which:

DESCRIPTION OF THE PREFERRED EMBODIMENT

This invention pertains to a means for energizing a color television picture tube during manufacture. The invention also provides for disconnecting a source of high potential from a socket which is not coupled to a color television picture tube.

The present invention will now be described. This invention is for use in the manufacture of a color television picture tube having an envelope containing an electron gun assembly and a base attached to a neck of the envelope. The base has electrically conductive pins connected to elements of the electron gun assembly wherein a first of the pins on the base carries a relatively high focus potential of many kilovolts and a second of the pins carries a substantially higher main focus lens potential. A means for energizing the tube during manufacture comprises a socket for coupling to the base of the tube wherein the socket has a lead attached to a source of high potential, the lead being characterized by having a switch. The switch has an electrically nonconductive casing filled with a dielectric fluid. An electrically conductive contact plate within the electrically nonconductive casing is connected to the socket by a first wire; and an electrically conductive chain within the electrically nonconductive casing has a first end connected to the high potential source by a second wire. The second end of the chain is free within the electrically nonconductive casing, and the chain is sufficiently long to contact the contact plate. The chain contacts the contact plate when the casing is in a first position wherein the socket is coupled to the base of the tube. Means is provided for supporting the switch in an inverted position when the socket is decoupled from the tube. This causes the chain to fall away from the contact plate and thus de-energize the socket.

Figure 1:
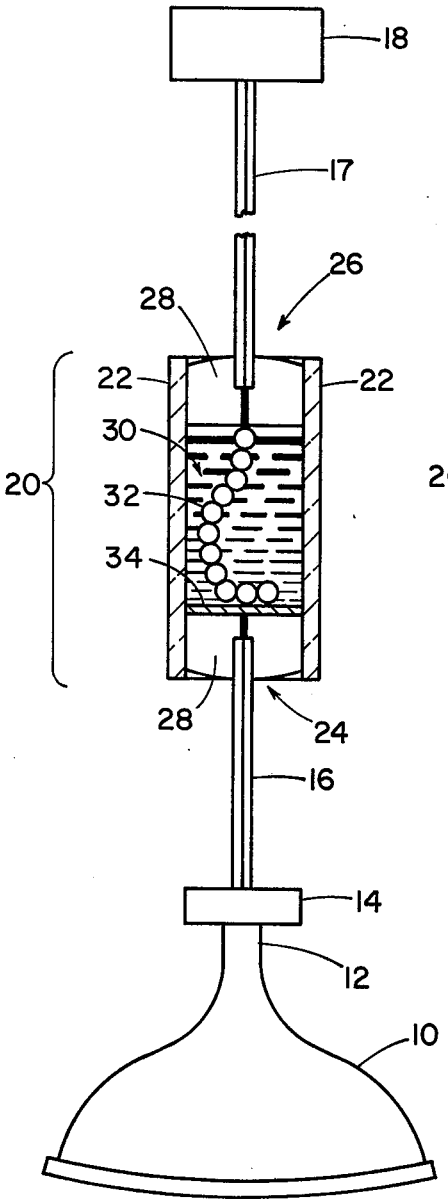
FIG. 1 schematically illustrates a means for energizing a color television picture tube during manufacture.
Figure 2:
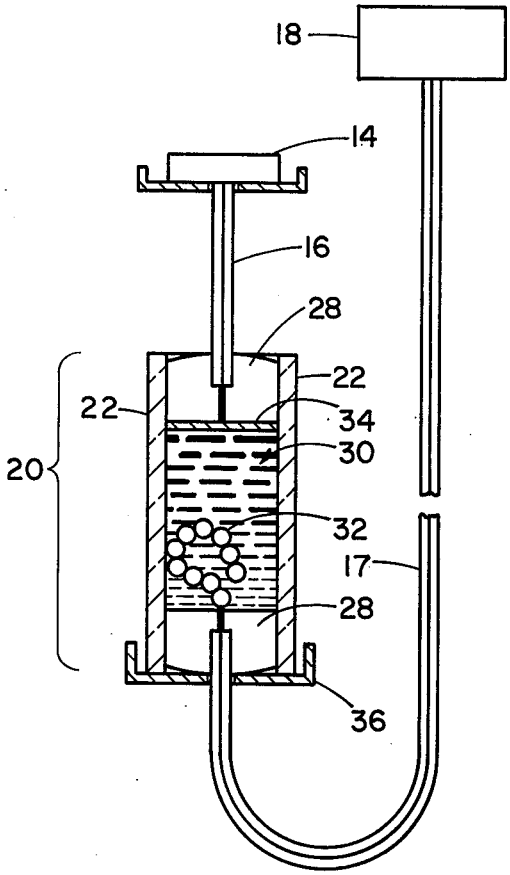
FIG. 2 schematically illustrates the FIG. 1 means utilized to de-energize a socket which is not coupled to a color television picture tube.

FIGS. 1 and 2 illustrate a preferred embodiment of the invention. In FIG. 1 a color cathode ray tube 10 with attached base 12 is coupled to a socket 14. The socket 14 is connected by a wire 16 to a switch 20 which in turn is connected by a wire 17 to a source of high potential 18. The switch 20 comprises an electrically nonconductive casing 22, e.g. glass, sealed at its ends 24 and 26 by a nonconductive material 28, for example, epoxy. The nonconductive casing 22 is filled with a dielectric fluid 30. The wire 16 attaches to an electrically conductive contact plate 34 within the casing 22. The wire 17 from the high potential source 18 connects to one end of an electrically conductive chain 32 within the electrically nonconductive casing 22. The chain 32 has one end free within the electrically nonconductive casing 22 and the chain 32 is sufficiently long to contact the contact plate 34. The chain 32 contacts the contact plate 34 when the casing 22 is in a first position wherein the socket 14 is coupled to the base 12 (as shown in FIG. 1).

A means 36 for supporting the switch 20 in an inverted position is provided and is utilized after the socket 14 is decoupled from the base 12 of the tube 10. This causes the chain 32 to fall away from the contact plate 34 and thus de-energize the socket 14.

The invention is not limited to the particular details of the apparatus depicted and other modifications and applications are contemplated. Certain changes may be made in the above-described apparatus without departing from the true spirit and scope of the invention herein involved. It is intended therefore that the subject matter in the above depiction shall be interpreted as illustrative and not in a limiting sense.

What is claimed is:

1. For use in the manufacture of a color television picture tube having an envelope containing an electron gun assembly and a base attached to a neck of said envelope, said base having electrically conductive pins connected to elements of said electron gun assembly wherein a first of said pins on said base carries a relatively high focus potential of many kilovolts and a second of said pins carries a substantially higher main focus lens potential, a means for energizing said tube during manufacture comprising:

a socket for coupling with said base on said tube wherein said socket has a lead attached to a source of high potential, said lead being characterized by having a switch comprising:

an electrically nonconductive casing filled with a dielectric fluid, an electrically conductive contact plate within said electrically nonconductive casing, said contact plate being connected to said socket by a first wire, and an electrically conductive chain within said electrically nonconductive casing, said chain having a first end connected to said high potential source by a second wire, said second end being free within said electrically nonconductive casing and said chain being sufficiently long to contact said contact plate, said chain contacting said contact plate when said casing is in a first position wherein said socket is coupled to said base, and means for supporting said switch in an inverted position after said socket is decoupled from said base of said tube to cause said chain to fall away from said contact plate and thus de-energize said socket.

* * * * *